US010919544B2

(12) United States Patent
Marco et al.

(10) Patent No.: US 10,919,544 B2
(45) Date of Patent: Feb. 16, 2021

(54) SYSTEM AND METHOD FOR INTERLOCKING A MECHANICAL GAP FILLER, A GUIDED VEHICLE DOOR AND A PLATFORM SCREEN DOOR

(71) Applicant: SIEMENS MOBILITY GMBH, Munich (DE)

(72) Inventors: Andre Marco, Puteaux (FR); Steffen Ueckert, Lehrte (DE)

(73) Assignee: Siemens Mobility GmbH, Munich (DE)

( * ) Notice: Subject to any disclaimer, the term of this patent is extended or adjusted under 35 U.S.C. 154(b) by 419 days.

(21) Appl. No.: 15/565,548

(22) PCT Filed: Mar. 8, 2016

(86) PCT No.: PCT/EP2016/054870

§ 371 (c)(1),
(2) Date: Oct. 10, 2017

(87) PCT Pub. No.: WO2016/162155

PCT Pub. Date: Oct. 13, 2016

(65) Prior Publication Data

US 2018/0118225 A1 May 3, 2018

(30) Foreign Application Priority Data

Apr. 7, 2015 (EP) ..... 15290093

(51) Int. Cl.

| | |
|---|---|
| ***B61B 1/02*** | (2006.01) |
| ***B61L 15/00*** | (2006.01) |
| ***B61L 25/02*** | (2006.01) |

(52) U.S. Cl.
CPC ..... *B61B 1/02* (2013.01); *B61L 15/0027* (2013.01); *B61L 25/025* (2013.01); *E05Y 2900/404* (2013.01)

(58) Field of Classification Search
CPC ..... B61B 1/02; E05Y 2900/404
USPC ..... 104/27, 28, 30
See application file for complete search history.

(56) References Cited

U.S. PATENT DOCUMENTS

| | | | | |
|---|---|---|---|---|
| 4,551,944 A * | 11/1985 | Donaldson | B61B 1/02 | 49/262 |
| 6,341,563 B1 * | 1/2002 | Gal | B61D 19/026 | 104/28 |
| 7,328,662 B2 * | 2/2008 | Kasai | B61B 1/02 | 104/30 |
| 7,677,178 B2 * | 3/2010 | Ellmann | B61B 1/02 | 104/27 |

(Continued)

FOREIGN PATENT DOCUMENTS

| | | |
|---|---|---|
| CN | 201062461 Y | 5/2008 |
| CN | 101432178 A | 5/2009 |

(Continued)

*Primary Examiner* — Zachary L Kuhfuss
(74) *Attorney, Agent, or Firm* — Laurence Greenberg; Werner Stemer; Ralph Locher

(57) ABSTRACT

A safety control system and a method configured for interlocking a Mechanical Gap Filler (hereafter MGF) with both a Platform Screen Door (PSD) and a Guided Vehicle Door (GVD) of a guided vehicle at standstill. The system is disposed along a platform in order to secure the exchange between the platform and a guided vehicle at standstill along the platform.

12 Claims, 1 Drawing Sheet

(56) References Cited

U.S. PATENT DOCUMENTS

| | | | | |
|---|---|---|---|---|
| 7,721,653 | B1 * | 5/2010 | Burgess | B61B 1/02 104/27 |
| 7,913,628 | B2 * | 3/2011 | Chisena | B61K 13/04 104/28 |
| 8,109,214 | B2 * | 2/2012 | Bradley | B61B 1/02 104/28 |
| 8,183,811 | B2 * | 5/2012 | Tate | B61B 1/02 318/280 |
| 8,387,541 | B2 * | 3/2013 | Losito | B61B 1/02 104/28 |
| 9,452,761 | B2 * | 9/2016 | Romero | B61B 1/02 |
| 9,884,635 | B2 * | 2/2018 | Miyajima | E05F 15/70 |
| 10,023,162 | B2 * | 7/2018 | Shiratsuchi | B61L 3/008 |
| 10,449,982 | B2 * | 10/2019 | Kashima | B61L 25/021 |
| 10,562,551 | B2 * | 2/2020 | Mizuno | B61L 23/00 |
| 2001/0042489 | A1 * | 11/2001 | Yamaguchi | B61B 1/02 104/30 |
| 2003/0070576 | A1 * | 4/2003 | Vincent-Genod | B61B 1/02 104/30 |
| 2008/0134930 | A1 * | 6/2008 | Drago | B61B 1/02 105/436 |
| 2009/0165665 | A1 * | 7/2009 | Gunes | B61B 1/02 104/30 |
| 2010/0043664 | A1 * | 2/2010 | Winkelmann | B60R 3/02 104/31 |
| 2015/0246679 | A1 * | 9/2015 | Radczimanowski | B61B 1/02 104/28 |
| 2018/0118225 | A1 * | 5/2018 | Marco | B61B 1/02 |
| 2018/0362054 | A1 * | 12/2018 | Shi | B61B 1/02 |
| 2019/0001995 | A1 * | 1/2019 | Bourbon | B61B 1/02 |
| 2019/0024436 | A1 * | 1/2019 | Chen | B61L 15/0036 |
| 2019/0031218 | A1 * | 1/2019 | Hamada | B61L 25/023 |
| 2019/0084586 | A1 * | 3/2019 | Leizer | B61B 1/02 |
| 2019/0092357 | A1 * | 3/2019 | Mizuno | B61L 23/00 |

FOREIGN PATENT DOCUMENTS

| | | | |
|---|---|---|---|
| CN | 202439687 | U | 9/2012 |
| JP | 2005297670 | A | 10/2005 |
| JP | 2012245850 | A | 12/2012 |
| JP | 2013063693 | A | 4/2013 |
| KR | 20120013089 | A | 2/2012 |
| WO | 2015028318 | A1 | 3/2015 |

* cited by examiner

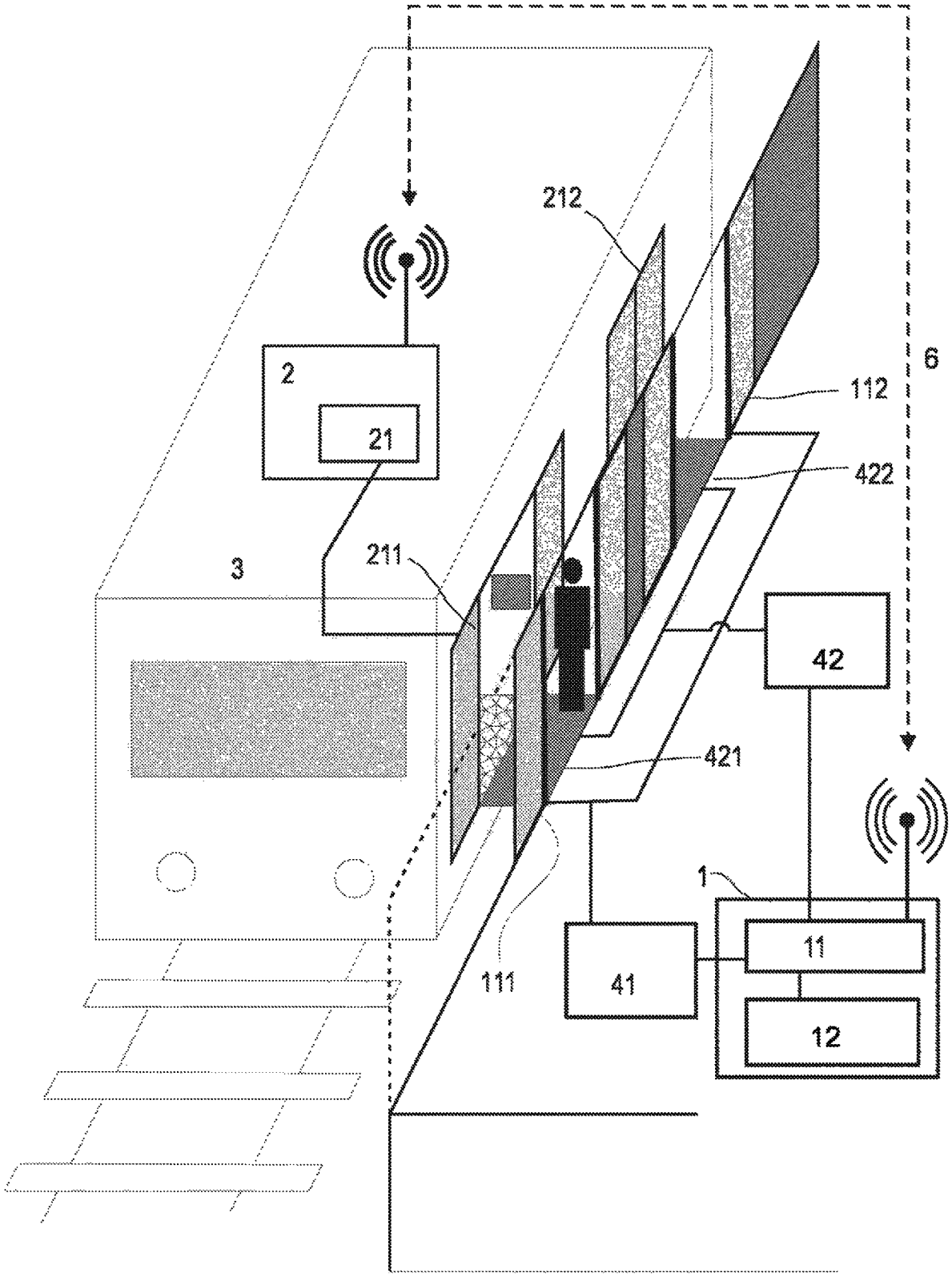
212
6
2
21
112
422
3
211
42
421
1
11
111
41
12

SYSTEM AND METHOD FOR INTERLOCKING A MECHANICAL GAP FILLER, A GUIDED VEHICLE DOOR AND A PLATFORM SCREEN DOOR

BACKGROUND OF THE INVENTION

Field of the Invention

The present invention concerns a system and a method for interlocking a mechanical gap filler (MGF), a guided vehicle door (GVD) and a platform screen door (PSD).

The MGF is a device known in the art that is aimed at reducing/filling a gap between a platform and an entrance of a passenger guided vehicle at a station, in particular in the case of a curved track at a station. Thanks to the MGF, a fall of a passenger in the gap is prevented and passenger exchange between the platform and the guided vehicle is thus safer. Existing MGFs are either installed on-board a guided vehicle wherein it cooperates with a GVD, or mounted along edges of a platform wherein it cooperates with a PSD. If a MGF is installed on-board a guided vehicle, then the MGF extension is done at the same time as the GVD opening. In this case, PSD are generally opened synchronously with GVDs. If a MGF equips a platform, then the MGF extension is done at the same time as PSD opening. Guided vehicle control systems are configured for stopping the guided vehicle at a specific location at a station so that the GVD is facing a PSD, wherein either the PSD or the GVD is equipped with a MGF.

Nevertheless, it arrives that a MGF does not extend fully, which leads to hazardous situations wherein the gap between the platform and the guided vehicle is not filled at all or only partly filled.

For example, some MGF systems interlock mechanically the GVD opening and MGF extension so that, in case of incomplete MGF extension, the GVD can only be partly opened or remain completely closed. In that case, passengers on the platform are facing an opened PSD, while the gap between guided vehicle and platform is not filled. The abnormal situation is only revealed to passengers on platform by closed or not fully opened doors of the guided vehicle. For MGFs equipping platforms, a MGF extension failure may result in a closed or not fully opened PSD. On-board passengers are thus facing an opened GVD, but a closed or not fully opened PSD. In each case, since the whole gap is not covered by the MGF, a risk of falling into the gap remains for the passengers stepping over said gap.

SUMMARY OF THE INVENTION

The present invention aims to improve the safety of passengers that have to step over the gap located between a guided vehicle and a platform of a station for entering into or leaving said guided vehicle at said station. An objective of the present invention is thus to propose a system and a method for securing the exchange of passengers between the guided vehicle and the platform at a station by preventing a passenger fall into the gap.

"Guided vehicle" according to the present invention refers to vehicles that comprise guiding means for guiding the guided vehicle along a predefined path or track. They are for example public transport means such as subways, trains or train units, etc., for which safety is a very important factor and which are in particular optically guided for following said track or path or guided along a railway or track by at least one rail, in particular by two rails.

The present invention proposes a method and a safety control system that are configured for interlocking a MGF with both a PSD and a GVD.

Preferentially, the invention provides a safety control system for controlling an opening/closing state of a PSD, an opening/closing state of a GVD, and an extension/retraction state of a MGF, wherein the GVD, the PSD and the MGF are aligned with each other to allow an exchange of passengers between a platform and a guided vehicle, the safety control system comprising:

- a communication device capable of communicating with respectively a control system of the GVD, a control system of a PSD, and a control system of a MGF for allowing a processing unit to exchange data with the latter, wherein said data comprises in particular and respectively information about an opening/closing of the GVD and information about an opening/closing of the PSD, and information about an extension/retraction of the MGF;
- the processing unit capable of communicating with the GVD control system, with the PSD control system and with the MGF control system for exchanging said data via said communication device, the processing unit being further capable of determining
  - an extension/retraction state of the MGF from information about the extension/retraction of the MGF, said extension/retraction state being e.g. one of the followings: fully extended, partly extended, or retracted;
  - an opening/closing state of the PSD from information about the opening/closing of the PSD, said opening/closing state of the PSD being e.g. one of the followings: fully opened, partly opened, or closed; and
  - an opening/closing state of the GVD from information about the opening/closing of the GVD, said opening/closing state of the GVD being e.g. one of the followings: fully opened, partly opened, or closed;
- wherein the MGF extension/retraction state, the opening/closing state of the PSD and GVD are determined from said data, the processing unit being further configured for generating at least one, preferentially both of the following signals:
  - a first signal configured for either triggering an opening of the PSD and GVD by respectively the PSD control system and the GVD control system if the extension/retraction state of the MGF is determined to be fully extended, or preventing the PSD control system and the GVD control system to open respectively the PSD and the GVD if the extension/retraction state of the MGF is determined to be retracted or partly extended;
  - a second signal configured for either preventing the MFG control system to retract the MGF if the closing/opening state of the PSD or GVD is determined to be fully opened or partly opened, or triggering a retraction of the MGF by the MGF control system if the closing/opening state of both the PSD and GVD is determined to be closed.

Preferentially, the processing unit is further configured for performing at least one of the following sendings, preferentially both:

- a sending, notably via said communication device, of the first signal to the PSD control system and the GVD control system before any opening of the PSD and GVD;

a sending, notably via said communication device, of the second signal to the MGF control system before any retraction of the MGF by the MGF control system.

The first signal is for example characterized by a first state that is able to trigger an opening of the PSD and GVD by respectively the PSD control system and the GVD control system and a second state that is able to prevent the PSD control system and the GVD control system to open respectively the PSD and the GVD. Similarly, the second signal is for example characterized by a first state that is able to trigger a retraction of the MGF by the MGF control system and a second state that is able to prevent the MFG control system to retract the MGF. According to the present invention, the first state of the first signal is for instance a permissive state and the second state of the first signal is a restrictive state. Similarly, the first state of the second signal is for instance a permissive state, and the second state of the second signal is a restrictive state.

According to the present invention, the PSD control system, respectively the GVD control system, is in particular configured for opening the PSD, respectively the GVD, if and only if it receives said first signal characterized by the first state, and it is further configured to maintain the PSD, respectively the GVD, closed if it receives the first signal characterized by the second state. Similarly, the MGF control system is in particular configured for retracting the MGF if and only if it receives the second signal characterized by the first state, and for maintaining the MGF extended if it receives the second signal characterized by the second state.

Preferentially, the safety control system according to the invention comprises the MGF control system, and/or the GVD control system, and/or the PSD control system. The MGF control system is preferentially configured for controlling a motion of the MGF, said motion being either an extension or a retraction of the MGF. The GVD control system is preferentially configured for controlling the opening/closing of the GVD. The PSD control system is preferentially configured for controlling the opening/closing of the PSD.

In particular, the MGF control system comprises a sensing device capable of detecting an extension/retraction of the MGF and configured for providing the processing unit with said data, for instance a signal, comprising said information about the extension/retraction of the MGF. In particular, the processing unit is able to determine the extension/extraction state of the MGF from said data or signal transmitted by the MGF control system or its sensing device.

In particular, the GVD control system comprises a sensing device capable of detecting an opening/closing of the GVD and configured for providing the processing unit with said data, for instance a signal, related to the detected opening/closing of the GVD, i.e. comprising information about the opening/closing of the GVD. In particular, the processing unit is able to determine the opening/closing state of the GVD from said data or signal transmitted by the GVD control system or its sensing device.

In particular, the PSD control system comprises a sensing device capable of detecting an opening/closing of the PSD and configured for providing the processing unit with said data, e.g. a signal, related to the detected opening/closing of the PSD, i.e. comprising information about the opening/closing of the PSD. In particular, the processing unit is able to determine the opening/closing state of the PSD from said data or signal transmitted by the PSD control system or its sensing device.

The safety control system might be in particular installed on-board a guided vehicle, or at the station. The MGF and MGF control system according to the invention might be installed on-board, or on a platform. The safety control system, the MGF control system, the PSD control system and the GVD control system may communicate with one another wirelessly. Preferentially, the safety control system is configured according to a centralized design wherein the safety control system communicates with the PSD control system, the GVD control system and the MGF control system for collecting the above-mentioned data.

The present invention also concerns a method for securing an exchange of passengers between a platform and a guided vehicle at standstill at said platform, by interlocking a MGF with both a PSD and a GVD of the guided vehicle at standstill along said platform. Said method being further and preferentially configured for controlling an extension/retraction of a MGF, of an opening/closing of a PSD and of an opening/closing of a GVD, for a guided vehicle at standstill at the platform, wherein the MGF, the PSD and the GVD are aligned with each other for allowing passenger exchange between the platform and the guided vehicle, the method comprising at least one, preferentially both of the steps (i)-(ii):

(i) before opening a GVD or a PSD, and notably for each MGF, PSD and GVD that are aligned with each other:
- determining an extension/retraction state of the MGF among fully extended, partly extended, or retracted by means of a processing unit of a safety control system; then
- sending, to the PSD control system and to the GVD control system, a first signal configured for either triggering the PSD control system and the GVD control system to open respectively the PSD and the GVD if the extension/retraction state of the MGF is determined to be fully extended, or preventing the PSD control system and the GVD control system to open respectively the PSD and the GVD if the extension/retraction state of the MGF is determined to be retracted or partly extended;

(ii) before retracting a MGF, and notably for each MGF, PSD and GVD that are aligned:
- determining an opening/closing state of the PSD and of the GVD that is one of the followings: fully opened, partly opened, or closed;
- sending, to the MGF control system, a second signal configured for either preventing the MFG control system to retract the MGF if the opening/closing state of the PSD or GVD is determined to be fully opened or partly opened, or triggering a retraction of the MGF by the MGF control system if the opening/closing state of both the PSD and GVD is determined to be closed.

Preferentially, the MGF control system is a wayside device configured for automatically communicating the data related to the extension/retraction state to the processing unit that is e.g. an on-board device. In particular, the processing unit is configured for triggering a simultaneous opening of the PSD and GVD only if the MGF is in the state fully extended. Each of the first and second signals might be sent wirelessly.

The present invention prevents vitally from passenger exchange while a MGF is not fully extended by interlocking the MGF with the PSD and GVD. Advantageously, in case of MGF extension failure, a driver or traffic controller has time to warn passengers of the gap between guided vehicle and platform before enforcing the GVD/PSD opening. The present invention also prevents vitally from MGF retraction while GVD or PSD are opened. Consequently, the passenger exchange can only take place when the MGF is fully extended and the fall of passengers between platform and guided vehicle is always prevented. According to the present invention, hazardous situations in case of MGF extending failure, like PSD opened and GVD closed or PSD closed and GVD opened, are always prevented. Preferentially, the processing unit is configured to send to a guided vehicle control system a third signal, wherein said third signal is configured for preventing any motion of the guided vehicle if at least one MGF is in a state different from retracted. For example, even if MGF is platform equipment, then the movement of the guided vehicle is vitally inhibited if one MGF is not fully retracted in order to prevent damages to platform and/or guided vehicle. Optionally, this inhibition can be overridden by a local MGF override switch. Usually, in case of a PSD and/or GVD and/or MGF failure, individual override signals might be defined in order to by-pass the first and/or second signal generated by the processing unit and resume operation. These additional individual override signals are not further developed here, but nevertheless, the safety control system according to the invention is in particular able to cooperate with such individual override signals.

BRIEF DESCRIPTION OF THE SEVERAL VIEWS OF THE DRAWING

Further aspects of the present invention will be better understood through the following drawings, wherein like numerals are used for like and corresponding parts:

The FIGURE is a schematic illustration of the safety control system according to the invention.

DESCRIPTION OF THE INVENTION

The FIGURE shows a preferential embodiment of a safety control system 1 for interlocking a MGF 421, 422, with both a PSD 111, 112 and a GVD 211, 212. Said safety control system 1 comprises a communication device 11 and a processing unit 12.

The communication device 11 is able to communicate and exchange data with respectively a GVD control system 21, a PSD control system 41, and MGF control system 42. The GVD control system might be included in a control system 2 of the guided vehicle 3 that is configured for controlling and commanding the guided vehicle 3. According to the preferential embodiment of FIG. 1, the safety control system 1 is in particular installed at a station. It is for instance a wayside device equipping a platform or a station. In this case, the PSD control system 41 is also installed on the platform, and the MGF control system 42 might be a wayside device (as shown in FIG. 1) equipping the platform or station—in this case the MGF 421, 422 is installed on the platform—, or an on-board device if the MGF is installed on-board the guided vehicle 3. According to other embodiments of the present invention, the safety control system 1 might equip the guided vehicle 3, being thus installed on-board said guided vehicle 3, while the PSD control system 41 remains a wayside device installed e.g. at a station or on the platform, and the MGF control system 42 might be installed either on-board in case of on-board MGF, or equip the station/platform in case of MGF installed along an edge of the platform. Preferentially, the devices mounted on-board (e.g. GVD control system and optionally the MGF control system and/or the safety control system) communicate with wayside devices (e.g. the PSD control system and optionally the MFG control system and/or the safety control system) using wireless communication 6. According to a further preferential embodiment, the safety control system 1 might comprise parts that are on-board equipment, and parts that are wayside equipment.

The control system 2 of the guided vehicle 3 is configured for positioning the guided vehicle 3 along the platform so that each GVD 211, 212 is aligned with a PSD 111, 112 and a MGF 421, 422. For each set of one PSD, one MGF and one GVD that are aligned with each other, the processing unit 12 is able to cooperates with respectively the PSD control system 41, the MGF control system 42, and the GVD control system 21, for collecting and receiving data that are respectively related to information about an opening/closing of the PSD 111, 112, information about an extension/retraction of the MGF 421, 422, and information about an opening/closing of the GVD 211, 212.

In particular, the processing unit 12 is configured for collecting said data each time an opening or closing command of the PSD 111, 112 and/or of the GVD 211, 212, and/or an extension/retraction command of the MGF 421, 422 is generated, for example, by the control system 2 of the guided vehicle, or by an automatic control system of the station. Preferentially, the MGF control system 42 is configured for automatically providing the processing unit 12 with said information about an extension/retraction each time it receives a command for extending or retracting one MGF 421, 422. Preferentially, the PSD control system 41 is configured for automatically providing the processing unit 12 with said information about an opening/closing of a PSD 111, 112 each time it receives a command for opening or closing said PSD 111, 112. Preferentially, the GVD control system 21 is configured for automatically providing the processing unit 12 with said information about an opening/closing of a GVD 211, 212 each time it receives a command for opening or closing said GVD 211, 212.

In order to collect or receive said data, the processing unit 12 cooperates with the communication device 11. From the data received/collected from respectively the MGF control system 42, the PSD control system 41, and the GVD control system 21, the processing unit 12 is configured for determining, for each set comprising one PSD 111, 112, one MGF 421, 422, and one GVD 211, 212 wherein the PSD 111, 112, the MGF 421, 422, and the GVD 211, 212 are aligned with each other, respectively:

an extension/retraction state of the MGF 421, 422 from said information about the MFG extension/retraction, the extension/retraction state being either fully extended, or partly extended, or retracted, and said determination taking place notably before an opening of a GVD 211, 212 or of a PSD 111, 112;

an opening/closing state of the PSD 111, 112 from said information about the PSD opening/closing, the opening/closing state of the PSD being either fully opened, or partly opened, or closed, and said determination taking place notably before a retraction of the MGF 421, 422; and an opening/closing state of the GVD from said information about the opening/closing of the GVD 211, 212, said GVD opening/closing state being either fully opened, or partly opened, or closed, and said determination taking place notably before a retraction of the MGF 421, 422.

According to a preferential embodiment of the present invention, for each set comprising one MGF, one PSD and one GVD that are aligned with each other when the guided vehicle is at standstill along a platform equipped with PSD, the processing unit 12 is configured for performing at least one of the following sendings (i)-(ii):

(i) sending, before any opening of the PSD or GVD, a first signal to the PSD control system and to the GVD control system, wherein said first signal is configured for either triggering an opening of the PSD and GVD by respectively the PSD control system and the GVD control system if the state of the MGF is determined to be fully extended, or preventing the PSD control system and the GVD control system to open respectively the PSD and the GVD;

(ii) sending, before any retraction of the MGF, a second signal to the MGF control system, wherein said second signal is configured for either preventing the MFG control system to retract the MGF if the state of the PSD or GVD is determined to be fully opened or partly opened, or triggering a retraction of the MGF by the MGF control system if the states of both the PSD and GVD are determined to be closed.

According to the present invention, the first and the second signals might be distinct signals, or different states or values of a same signal generated by the processing unit. For example, the processing unit is configured for generating a single signal that is characterized by four states or values, two states corresponding to the first and second states of the first signal, and two states corresponding to the first and second states of the second signal. For instance, said single signal comprises a first state or value configured for triggering an opening of the PSD and GVD by respectively the PSD control system and the GVD control system and that corresponds to the first state of the first signal, a second state or value configured for preventing the PSD control system and the GVD control system to open respectively the PSD and the GVD and that corresponds to the second state of the first signal, a third state or value configured for triggering a retraction of the MGF by the MGF control system and that corresponds to the first state of the second signal, and a fourth state or value configured for preventing the MFG control system to retract the MGF and that corresponds to the second state of the second signal.

To summarize, the present invention proposes to interlock a MGF, a PSD and a GVD so that:

the full MGF extension is checked before any door (PSD/GVD) opening, avoiding therefore hazardous situations wherein the gap between a platform and a guided vehicle is not filled at all or partly filled and passengers are not warned of this danger before door opening;

both GVD and PSD closed states are checked before MGF retraction in order to avoid unsafe situations wherein the MGF retracts while passengers are still on it.

The invention claimed is:

1. A safety control system for interlocking a mechanical gap filler (MGF) with both a platform screen door (PSD) and a guided vehicle door (GVD) of a guided vehicle when the guided vehicle is at standstill along a platform, the safety control system comprising:

a communication device for communicating with a GVD control system, with a PSD control system and with a MGF control system; and a processing unit configured for exchanging data with the GVD control system, with the PSD control system and with the MGF control system via said communication device, said processing unit being further configured for determining from the data an extension/retraction state of the MGF, an opening/closing state of the PSD and an opening/closing state of the GVD, and wherein said processing unit is configured for generating both of the following signals:

i. a first signal configured for either triggering an opening of the PSD and GVD if the extension/retraction state of the MGF is in a "fully extended" state or preventing the PSD control system and the GVD control system to open respectively the PSD and the GVD if the extension/retraction state of the MGF is in a "retracted" state or a "partly extended" state;

ii. a second signal configured for either preventing the MGF control system from retracting the MGF if the closing/opening state of the PSD or GVD is in a "fully opened" state or a "partly opened" state, or triggering a retraction of the MGF if the closing/opening state of both the PSD and GVD is in a "closed" state.

2. The safety control system according to claim 1, wherein said processing unit is configured for cooperating with the communication device for sending the first signal to the GVD control system and PSD control system before any opening of the PSD or the GVD.

3. The safety control system according to claim 1, wherein said processing unit is configured for cooperating with the communication device for sending the second signal to the MGF control system before any retraction of the MGF.

4. The safety control system according to claim 1, wherein the first signal has a first state for triggering an opening of the PSD and GVD and a second state for preventing an opening of the PSD and the GVD, the second signal has a first state for triggering a retraction of the MGF and a second state for preventing the MGF control system from retracting the MGF.

5. The safety control system according to claim 1, wherein the data comprises information about at least one of the following: an opening/closing of the GVD, information about an opening/closing of the PSD, or information about an extension/retraction of the MGF.

6. The safety control system according to claim 1, which comprises at least one of the MGF control system, and/or the GVD control system, and/or the PSD control system.

7. The safety control system according to claim 6, wherein the PSD control system is configured for opening the PSD if and only if the PSD control system receives the first signal for triggering the opening of the PSD, and wherein the PSD control system is also configured to maintain the PSD in a closed position if the PSD control system receives the first signal for preventing the opening of the PSD.

8. The safety control system according to claim 6, wherein the MGF control system is configured for retracting the MGF if and only if the MGF control system receives the second signal in a state for triggering the retraction of the MGF, and wherein the MGF control system is configured for maintaining the MGF extended if the MGF control system receives the second signal in a state for preventing the retraction of the MGF.

9. The safety control system according to claim 6, wherein the GVD control system is configured for opening the GVD if and only if it receives the first signal for triggering the opening of the GVD, and wherein the GVD control system is also configured to maintain the GVD in a closed position if it receives the first signal for preventing the opening of the GVD.

10. The safety control system according to claim 1, wherein:

the extension/retraction state is one of the following: "fully extended," "partly extended," or "retracted;"

the opening/closing state of the PSD is one of the following: "fully opened," "partly opened," or "closed;"

the opening/closing state of the GVD is one of the following: "fully opened," "partly opened," or "closed."

11. A method for securing an exchange of passengers between a platform and a guided vehicle standing still at the platform, the method comprising:

interlocking a Mechanical Gap Filler (MGF) with both a Platform Screen Door (PSD) and a Guided Vehicle Door (GVD) of the guided vehicle while the guided vehicle is at standstill along said platform;

providing a communication device for communicating with a GVD control system, with a PSD control system and with a MGF control system; and providing a processing unit configured for exchanging data with the GVD control system, with the PSD control system and with the MGF control system via the communication device, the processing unit being further configured for determining from the data an extension/retraction state of the MGF, an opening/closing state of the PSD and an opening/closing state of the GVD, and wherein the processing unit is configured for generating both of the following signals:

i. a first signal configured for either triggering an opening of the PSD and GVD if the extension/retraction state of the MGF is in a "fully extended" state or preventing the PSD control system and the GVD control system to open respectively the PSD and the GVD if the extension/retraction state of the MGF is in a "retracted" state or a "partly extended" state;

ii. a second signal configured for either preventing the MGF control system from retracting the MGF if the closing/opening state of the PSD or GVD is in a "fully opened" state or a "partly opened" state, or triggering a retraction of the MGF if the closing/opening state of both the PSD and GVD is in a "closed" state.

12. The method according to claim 11, comprising carrying out at least one of steps or, wherein the steps and are defined as follows:

(i) prior to opening the GVD or the PSD:

determining an extension/retraction state of the MGF;

sending a first signal to the PSD control system and to the GVD control system, the first signal being configured for either triggering the PSD control system and the GVD control system to open respectively the PSD and the GVD if the extension/retraction state of the MGF is a "fully extended" state or preventing the PSD control system and the GVD control system from opening respectively the PSD and the GVD if the extension/retraction state of the MGF is a "retracted" state or a "partly extended" state;

(ii) prior to retracting a MGF:

determining an opening/closing state of the PSD and of the GVD; sending a second signal to the MGF control system, the second signal being configured for either preventing the MGF control system from retracting the MGF if the opening/closing state of the PSD or of the GVD is a "fully opened" state or a "partly opened" state, or triggering a retraction of the MGF by the MGF control system if the opening/closing state of both the PSD and GVD is a "closed" state.

* * * * *